United States Patent [19]

Ettel et al.

[11] 4,274,930

[45] Jun. 23, 1981

[54] PROCESS FOR RECOVERING COBALT ELECTROLYTICALLY

[75] Inventors: Victor A. Ettel; Eric A. P. Devuyst; Juraj Babjak, all of Mississauga; John Ambrose; Gerald V. Glaum, both of Oakville, all of Canada

[73] Assignee: The International Nickel Company, Inc., New York, N.Y.

[21] Appl. No.: 172,751

[22] Filed: Jul. 28, 1980

[51] Int. Cl.[3] ..... C25C 1/08

[52] U.S. Cl. ..... 204/112; 204/128; 75/101 BE; 423/24; 423/92; 423/100; 423/138; 423/139

[58] Field of Search ..... 75/101 BE; 423/92, 138, 423/139, 100, 24; 204/112, 128

[56] References Cited

U.S. PATENT DOCUMENTS

| | | | |
|---|---|---|---|
| 3,809,624 | 5/1974 | Kane et al. | 204/112 |
| 4,004,990 | 1/1977 | Suetsuna et al. | 75/101 BE |
| 4,123,260 | 10/1978 | Sefton et al. | 75/101 BE |

*Primary Examiner*—R. L. Andrews

*Attorney, Agent, or Firm*—Raymond J. Kenny; Miriam W. Leff

[57] ABSTRACT

A cobaltic oxide hydrate is mixed with spent sulfate electrolyte and the slurry is sparged with air to liberate any entrained chloride ions as gaseous chlorine. Thereafter a reducing agent is used to enable dissolution of the cobalt and obtaining of a chloride-free solution from which, after purification, cobalt can be electrowon.

12 Claims, No Drawings

PROCESS FOR RECOVERING COBALT ELECTROLYTICALLY

FIELD OF THE INVENTION

The present invention relates to the electrolytic recovery of cobalt, and more specifically to its recovery from a cobaltic oxide hydrate which is contaminated with chloride ions.

BACKGROUND OF THE INVENTION

The recovery of cobalt from various process streams can conveniently be carried out by first precipitating the cobalt as a hydrated oxide and thereafter redissolving to produce an electrolyte from which cobalt can be electrowon. Where, as is common, the process stream contains significant amounts of other metals, most notably nickel, significant upgrading of the relative amount of cobalt present is achievable by precipitating the cobalt under oxidative conditions which ensure the formation of its trivalent oxide hydrate, sometimes referred to as cobaltic hydroxide, $CO(OH)_3$. Such an oxidative precipitation is achieved if the process stream is treated with sodium hypochlorite or chlorine in the presence of a base.

While from an economic viewpoint the procedure of forming a cobaltic oxide hydrate with the aid of chlorine is attractive, an impediment to its commercial application stems from the fact that the resulting filter cake is contaminated with chloride ions. Two undesirable consequences flow from such entrained chloride which contaminates the electrolyte from which cobalt is to be electrowon. Firstly it necessitates the use of relatively expensive anodes for the electrowinning operation since the commonly used lead alloy anodes would corrode rapidly in a chloride-containing electrolyte. Moreover, electrowinning from chloride-containing electrolytes is accompanied by chlorine evolution which is environmentally objectionable and necessitates the use of more elaborate cells with means for containing and exhausting the atmosphere.

OBJECT OF THE INVENTION

An object of the present invention is to provide a procedure by which a chloride-contaminated filter cake of cobaltic oxide hydrate can be used to produce a solution from which electrowinning can be carried out without the above-mentioned impediments.

SUMMARY OF THE INVENTION

The present invention provides a process in which a feed which consists of a cobaltic oxide hydrate precipitate is dissolved in a spent sulfate electrolyte from a cobalt electrowinning operation and in which at least one of the feed and spent electrolyte is contaminated with chloride ions, wherein the improvement comprises mixing the feed with the spent electrolyte to form a slurry, sparging air through the slurry for a period sufficient to liberate as gaseous chlorine substantially all of the chloride ions in the slurry, and thereafter treating the dechlorinated slurry with a reducing agent selected from the group consisting of sulfur dioxide, hydrogen peroxide and organic reagents capable of reducing cobalt to its divalent state; whereby substantially all of the cobalt in the feed is dissolved to provide a substantially chloride-free cobalt-containing solution from which pure cobalt can be electrowon.

Particularly useful materials for preparing the cobalt feed precipitate used in the process of the invention are mixed cobalt-nickel basic precipitates which are formed as intermediates in various nickel recovery schemes. Providing the mixed precipitate contains nickel in an amount at least equal to its cobalt content, the basic nickel compound can be relied on as the base needed to precipitate the desired cobaltic compound as follows. The mixed precipitate is separated into two fractions. A first of these fractions is dissolved in a dilute mineral acid-containing aqueous solution. This solution is then treated with chlorine while the second fraction of mixed precipitate is added in a controlled manner such as to ensure that a pH between about 2.5 and 4.5 is maintained. In this way substantially all of the cobalt in the mixed precipitate reports as a cobaltic oxide hydrate which contains only a minor portion of the nickel present in the mixed precipitate. This method of preparing the cobaltic precipitate feed inevitably results in chloride contamination thereof.

It has been found that the procedure of slurrying the feed precipitate with the acidic sulfate solution which consists of spent electrolyte and subjecting the slurry to an air sparge is an effective means of liberating substantially all of the entrained chloride ions as gaseous chlorine. The dechlorination step is necessary and is equally effective, regardless of whether the contaminant chloride was present in the feed precipitate or in the spent electrolyte used. It is essential that this dechlorination of the slurry takes place prior to the leaching operation, i.e., prior to introduction of the reducing agent into the slurry. This is because the cobaltic precipitate plays a role in the dechlorination which is believed to proceed by virtue of the following reaction:

$$2Co(OH)_3+2H_2SO_4+2H^++2Cl^-\rightarrow 2CoSO_4+Cl_2+6H_2O$$

The above reaction can be carried out at room temperature, but for kinetic reasons it is preferred to perform it at a temperature of the order of 60°–65° C. Under such conditions a residual chloride concentration of less than 20 mg/l can be attained in about 30 minutes by sparging air and also imparting mechanical agitation to the slurry.

Subsequent to this pre-leaching operation, a reducing agent is used to induce dissolution of the cobaltic precipitate. The reducing agent can be sulfur dioxide, in which case the leach is believed to involve the following reaction:

$$2Co(OH)_3+H_2SO_4+SO_2\rightarrow 2CoSO_4+4H_2O$$

Because dissolution in this manner adds to the sulfate ion concentration, it becomes necessary to control its build-up. This can be done by bleeding a portion of the cobalt sulfate solution, preferably after it has been purified, and treating it with sodium carbonate to precipitate cobalt carbonate, part of which is used to treat impure electrolyte to remove iron therefrom while the remainder is redissolved in the purified electrolyte to adjust the pH thereof.

Alternatively, the cobaltic precipitate can be dissolved without sulfate build-up if use is made of a reductant other than sulfur dioxide. Hydrogen peroxide can be used as a reducing agent for this purpose, though its cost makes it less attractive than other reagents. It is known, however, that many organic reagents are oxidized by cobaltic hydroxide, i.e., such reagents are capable of reducing the cobalt to its divalent state. Thus the use of alcohols, aldehydes and ketones for this purpose is suggested by publications such as "Oxidation of Some Organic Compounds By Cobaltic Hydroxide" by S. Ludwik, in Roczniki Chemii, 1973, 47, p. 43, and "Reactions of the Cobaltic Ion, Part III: The Kinetics of the Reaction of the Cobaltic Ion with Aldehydes and Alcohols" by C. E. H. Bawn and A. G. White, in J. Chem. Soc., 1951, p. 343.

We particularly prefer to use methanol as the reducing agent for cobalt, in which case the reaction which takes place is believed to be as follows:

$$6Co(OH)_3+6H_2SO_4+CH_3OH \rightarrow 6CoSO_4+CO_2+17H_2O$$

This reaction proceeds rapidly in the initial stages of dissolution. However we have found that after cobalt dissolution has proceeded to the extent of 85–90% completion, the leach becomes slower and it is preferable for that reason to resort to a different reductant to complete the leach. The final treatment can be conveniently performed with sulfur dioxide or with hydrogen peroxide. When this is done, an overall dissolution of 98–99% of the cobalt can be achieved with a total leaching time similar to that needed when sulfur dioxide is used as the sole reductant. When $SO_2$ is used for all or part of the leach, it is desirable to employ a brief air sparge subsequent to the leach, to eliminate any excess $SO_2$ from the solution.

While the dechlorination operation carried out in accordance with the invention removes from the slurry chloride ions which were present as such in either the feed cake or the recycled spent electrolyte, a problem may arise if the electrolyte contains chlorate ions. The latter may result from chloride contamination of pregnant electrowinning electrolyte, due to impure reagents added, for example, to control the pH. The anodic conditions during electrowinning can result in formation of chlorate ions from any chloride in solution. If this chlorate contamination is left unchecked, the air sparging treatment would not succeed in removing the chlorate, and the subsequent reduction leach of cobalt would be accompanied by reduction of the chlorate so that the "dechlorinated" slurry would be recontaminated with chloride ions. Accordingly, where chlorate ions may be present in the recycled spent electrolyte, we avoid the above-described problem by reducing the chlorate ions to chloride ions prior to slurrying that electrolyte with the cobaltic feed. This can be accomplished in many known ways, such as by means of a short sparge with sulfur dioxide. Thus the sequence of operations in such a case is:

(i) treat the spent electrolyte with sulfur dioxide to reduce $ClO_3^-$ to $Cl^-$;
(ii) slurry the treated electrolyte with the cobaltic feed precipitate;
(iii) subject the slurry to an air sparge to liberate as gaseous chlorine the $Cl^-$ present in both the precipitate and solution; and
(iv) introduce the reducing agent needed to effect cobalt dissolution.

While at the end of the leaching operation some residue will remain undissolved, it is unnecessary to separate it at this point of the procedure since it is economically desirable to minimize the number of solid-liquid separations in any commercial operation. Accordingly, the residue can be left with the solution until the latter has been treated to remove lead and iron therefrom and the combined residue and precipitated impurities can then be separated from the solution.

The removal of lead and iron from the cobalt solution can be carried out in any conventional manner. We prefer to treat the solution with barium carbonate for lead removal and thereafter with cobalt carbonate for iron removal. Where copper is present as impurity, some of the copper may be precipitated in the iron removal stage.

According to a preferred embodiment of the invention the impurities zinc, copper and nickel are removed by means of ion exchange resins. Such a manner of purification is rendered economically acceptable by its use in conjunction with an electrowinning operation which is carried out with a high cobalt bite, i.e., a depletion of the cobalt concentration in the electrolyte by at least about 35 grams/liter. By operating with such a bite, use is made of concentrated electrolytes, so that purification of a given amount of cobalt entails treating a relatively small volume of electrolyte which can be treated in a relatively small resin bed.

For zinc removal we prefer to use a resin which contains di(2-ethylhexyl) phosphoric acid (which is hereinafter referred to as D2EHPA). One such resin which is available commercially from Bayer AG is known by the designation: Lewatit TM OC1026 and is a macroporous copolymer of styrene-divinylbenzene containing about 150 grams of D2EHPA per liter of resin bed. The use of this resin for zinc removal from sulfate solutions containing 40 g/l of cobalt has been reported by others, and we have found it effective for treating the more concentrated solutions preferred in the process of the present invention wherein the cobalt level is of the order of 100 g/l or more.

Removal of nickel is preferably carried out in the manner described and claimed in copending application, Ser. No. 172,670, filed 7-28-1980 and assigned in common with the present invention. The procedure makes use of a resin having bis (2-picolyl)amine functional groups, such a resin being available from Dow Chemicals under the designation: XF4195. While the reported selectivity of this resin between cobalt and nickel is less attractive than the selectivity reported for many other resins, the XF4195 resin was found to be much more effective than any of such other resins for removing nickel down to low levels from concentrated cobalt solutions.

Currently used procedures for electrowinning cobalt invariably entail use of bag-free cells and operation with relatively low cobalt bite (i.e., less than 15 g/l) in order to attain acceptable current efficiency. While the use of cathode boxes to achieve higher bites is well known in the art of nickel electrowinning, cobalt producers have been prevented from adopting such procedures by the tendency for cobalt oxide slimes and possibly also gypsum to precipitate and hence cause clogging of the diaphragms. We have found surprisingly that if the bite sought is not slightly but substantially higher, i.e., between about 35 and 60 g/l, e.g., 45 g/l, then providing diaphragm cells are employed, the electrowinning can proceed satisfactorily with high current efficiency and without slime formation problems. We prefer to use cells in which the diaphragm is provided in the form of a bag surrounding each anode, the anodes being of conventional lead based material since chloride ions are absent from the electrolyte.

To aid in understanding the present invention, some examples of the steps for recovering pure cobalt from cobaltic oxide hydrate precipitates will now be described.

EXAMPLE 1

A wet $Co(OH)_3$ cake was used, which contained 23% Co and 0.1% $Cl^-$. (Unless otherwise specified all percentages herein quoted are percentages by weight). Preliminary tests showed that if such a cake is merely dissolved in an acidic sulfate solution to produce an electrolyte containing of the order of 50 g/l of Co, the resulting electrolyte contains at least 0.2 g/l of $Cl^-$, which is very much higher than can be tolerated. The dechlorination procedure in accordance with the invention was carried out as follows:

3.45 kg of the cake was slurried with 14.5 liters of spent cobalt sulfate electrolyte which contained 42 g/l of Co, 0.23 g/l of Ni, 3.3 m/l of Pb and 85 g/l of $H_2SO_4$. The slurry was agitated mechanically and maintained at 65° C. while air was sparged through it for 30 minutes. At the end of that time assays showed that about 93% of the chloride ions had been eliminated, while only about 4% of the cobalt in the cake was dissolved. The filtrate at the end of the dechlorination assayed 20 mg/l $Cl^-$, 41 g/l Co and 1 g/l Ni.

To further test the efficiency of the dechlorination procedure, the above procedure was repeated with a solution which had been spiked with $Cl^-$ so that the initial concentration in the slurry liquid was 1 g/l $Cl^-$. The resulting slurry was sparged with air at 60° C. and sampled at various intervals determine the chloride content of the solution which was found to be as shown in Table 1.

TABLE 1

| Sparging Time (min) | $Cl^-$ Assay (mg/l) |
|---|---|
| 0 | 1,000 |
| 5 | 20 |
| 30 | 20 |
| 60 | 20 |
| 150 | 13 |

It is clear that dechlorination proceeds rapidly at this temperature and that an acceptable level of 20 mg/l of $Cl^-$ is attainable with a sparge duration of 30 minutes or less even when the solution as well as the feed cake is highly contaminated with $Cl^-$. Of course, as explained above, if the solution is contaminated with $ClO_3^-$ rather than $Cl^-$, air sparging alone will not remove the $ClO_3^-$ and it is necessary to reduce the $ClO_3^-$ to $Cl^-$ prior to formation of the slurry.

The dechlorinated slurry obtained in the manner described above was then subjected to a reductive leach by introducing sulfur dioxide into it at a sparging rate of 0.21 moles of $SO_2$ per liter per hour. Progress of the leach was followed by monitoring the redox potential (relative to a saturated calomel electrode). The initial redox potential of +900 mV had dropped to +200 mV after 130 minutes of leaching, corresponding to a sulfur dioxide consumption of 0.5 moles per mole of cobalt in the feed cake. At this point an assay showed that the solution contained:

| | |
|---|---|
| Cobalt | 91 g/l |
| Nickel | 1.5 g/l |
| Lead | 12 mg/l |

-continued

| | |
|---|---|
| Iron | 0.2 g/l |
| Copper | 15 mg/l |
| Zinc | 5 mg/l |

Lead was removed from the slurry by adding barium carbonate is an amount corresponding to 0.5 g/l of slurry, which reduced the lead in solution after 30 minutes to less than 0.1 mg/l.

The slurry was thereafter neutralized to pH 5.5 by adding to it 2.3 liters of a $CoCO_3$ slurry containing about 150 g/l of cobalt. The latter constituted a partial recycle of cobalt in that it had been prepared by treating a bleed stream of purified electrolyte with sodium carbonate. After filtration of the neutralized slurry, 17.8 liters of filtrate were obtained which analyzed:

| | |
|---|---|
| Cobalt | 99.5 g/l |
| Nickel | 1.27 g/l |
| Lead | <0.1 mg/l |
| Iron | 0.3 mg/l |
| Copper | 1.8 mg/l |
| Zinc | 3.8 mg/l |
| $Cl^-$ | 30 mg/l |

The leach residue separated from the above filtrate contained an amount of cobalt representing 1.5% of the cobalt present in the feed cake.

EXAMPLE 2

A similar test to that described in the previous example was carried out to investigate the use of methanol as reductant during the leach. In this case 8.2 kg of wet cobaltic oxide hydrate cake containing 25% Co and 0.1% $Cl^-$ were slurried with 36 liters of spent cobalt sulfate electrolyte containing:

| | |
|---|---|
| Cobalt | 54.6 g/l |
| Nickel | 0.18 g/l |
| Lead | 2 mg/l |
| Sulfuric Acid | 85 g/l |

After a 30 minute air sparge at 65° C. it was found that 90% of chloride had been liberated leaving an electrolyte which contained 45 g/l Co, 0.8 g/l Ni and 20 mg/l $Cl^-$.

Pure methanol was added to the dechlorinated slurry at a rate of 15 ml/hr/l of slurry. After 20 minutes, corresponding to a methanol addition of 0.17 moles of $CH_3OH$ per mole of cobalt in the feed cake, the pH of the slurry had increased from 0.6 to 1.6. At this point a sample of filtrate from the slurry assayed 89.5 g/l Co indicating extraction of about 88% of the cobalt present in the feed. The methanol introduction was discontinued and substituted by sulfur dioxide sparging at a rate of 0.21 moles/hr/l of slurry for 100 minutes at which time completion of the leach was evidenced by a drop in the redox potential from +700 mV to +440 mV at a pH of 2.3. The leach was followed by a 20 minute air sparge during which the redox potential rose to +690 mV. Analysis of the leach solution gave the following results:

| | |
|---|---|
| Cobalt | 98.2 g/l |
| Nickel | 1.12 g/l |
| Lead | 10 mg/l |

-continued

| | |
|---|---|
| Iron | 0.11 g/l |
| Copper | 15 mg/l |
| Zinc | 4 mg/l |

Removal of lead from this solution required two consecutive additions of $BaCO_3$. The first addition of 0.5 g of $BaCO_3$ per liter of slurry reduced the lead content to 0.4 mg/l after 15 minutes. An identical addition reduced the lead to 0.2 mg/l in a further 15 minutes.

The resulting slurry was neutralized to pH 5.4 by adding to it 1 liter of a $CoCO_3$ slurry containing about 100 g/l of cobalt. After filtration 40 liters of electrolyte were obtained which assayed 0.3 mg/l Fe and 3 mg/l Cu, while the separated residue represented 0.95% of the cobalt in the feed cake.

EXAMPLE 3

The following tests illustrate the removal of zinc by ion exchange from electrolytes having high concentrations of cobalt and high ionic strength.

A cobalt sulfate electrolyte containing 120 g/l Co, 1.2 g/l Ni, 0.020 g/l Zn and about 50 g/l $Na_2SO_4$ and having a pH of 5.5 measured at 22° C. was treated with 50 ml of "Lewatit OC1026" resin. The resin, which as stated earlier comprises a copolymer containing 150 grams of D2EHPA per liter of resin bed, was contained in a columnar bed 1.7 cm in diameter and 20 cm deep. The column was operated with a flow of 2 cubic meters of solution per hour per square meter of bed cross section ($m^3/m^2/hr$) and maintained at 50° C. After processing 0.5 liters of solution, i.e., 10 bed volumes (B.V.) the column effluent was found to analyze less than 0.2 mg/l Zn. This represents a ratio of Co to Zn in the purified electrolyte greater than $6\times10^5$.

On a larger scale a solution containing 100 g/l Co, 1 g/l Ni, 0.005 g/l Zn and 100 g/l $Na_2SO_4$ and having a pH of 5.0 measured at 22° C. was purified in a column 4.1 cm in diameter, 79 cm deep and containing 1 liter of the "Lewatit OC1026" resin. The column was operated at 60° C. and at a rate of 4.5 $m^3/m^2/hr$ to process 213 liters (i.e., 213 B.V.) of the solution, at the end of which time the effluent assayed only 0.7 mg/l Zn. This respresents a Co/Zn ratio higher than $1\times10^5$ in the purified electrolyte.

It is clear that a D2EHPA containing resin provides an effective method of removing zinc from the concentrated electrolytes of the invention. The extraction should be performed at a pH which is not less than about 2.5 and preferably the pH should be initially adjusted, if necessary, to a value in the range 4 to 6. The resin bed, once loaded, can be eluted with a dilute mineral acid, and thereafter re-used for further zine removal.

After passage through the resin bed, the electrolyte may contain some D2EHPA due to the slight solubility of the latter in aqueous solutions. To remove the small quantities of extractant from the electrolyte, the latter is preferably passed through a column of activated carbon.

EXAMPLE 4

The following tests illustrate the removal of nickel by ion exchange from electrolytes having high concentrations of cobalt and high ionic strength.

A solution containing 125 g/l Co, 2.04 g/l Ni and about 50 g/l $Na_2SO_4$ and having a pH of 6.1 measured at 22° C. was treated with Dow's bis (2-picolyl)amine resin in a fixed bed of 5 cm diameter and 3 meter depth containing 6 liters of the resin. The solution to be purified was passed upwards through the resin column at 50° C. and at a rate of $3m^3/m^2/hr$. Samples of the effluent taken after processing of various bed volumes of solution were analyzed for nickel. The results showed that after two bed volumes of solutions had been processed, the sample of effluent exiting from the bed contained only 33 mg/l of nickel, i.e., it represented an electrolyte with a Co/Ni ratio higher than 3000. A sample analysis of effluent exiting after about 4 B.V. had been processed showed a nickel content of 490 mg/l. By determining the average assay of the total effluent collected, it was determined that with such a starting solution as much as 6 B.V. could be treated in the column while obtaining a purified electrolyte in which the nickel did not exceed about 0.5g/l, i.e., the Co/Ni ratio was at least 200. Such an electrolyte enables cobalt of very high purity to be electrowon.

The above described ion exchange treatment is effective to remote not only nickel but also any copper present in the electrolyte. Stripping of the copper from the picolylamine resin is more difficult to accomplish than stripping of nickel from the loaded resin. For this reason we prefer to remove copper prior to using this resin. The removal of copper can be accomplished in various known ways, such as by using specific copper-selective ion exchange resins or solvent extractants such as carboxylic acid or oxime types of extractant.

EXAMPLE 5

A first purified electrolyte which contained:

| | |
|---|---|
| Cobalt | 89 g/l |
| Nickel | 20 mg/l |
| Lead | 0.4 mg/l |
| Zinc | 1.3 mg/l |
| Iron | 0.3 mg/l |
| Copper | 0.1 mg/l |

was used to electrowin cobalt in 2.5 liter laboratory cells as well as in larger 16 liter cells. The electrodes for these cells were $10\times15$ cm and $10\times35$ cm respectively, the anodes being made of a lead alloy containing 0.05% calcium and 0.5% tin. The cathodes were made of stainless steel. Each anode was surrounded by a diaphragm defining an anolyte compartment while the bulk of the cell space constituted a common catholyte compartment.

A small amount, 20–30 mg/l, of sodium lauryl sulfate was added to the electrolyte to act as antipitting and anti-misting agent. The electrolyte was then fed through the cells at a rate such that the cobalt bite was 41 g/l, the current density used being about 200 $A/m^2$. The cell temperature was 55° C. and the pH of the catholyte was 2.1. Cobalt was plated for 171 hours with a current efficiency of 92%. The plates deposited were found to contain the following impurities, in parts per million:

| | |
|---|---|
| Nickel | 87 ppm |
| Lead | 5 ppm |
| Zinc | 11 ppm |
| Iron | 16 ppm |
| Copper | 2.5 ppm |

A second electrowinning test was done using similar procedure except for the following differences. The electrolyte had a higher level of impurities, its assay being:

| | |
|---|---|
| Cobalt | 93 g/l |
| Nickel | 0.24 g/l |
| Lead | 0.2 mg/l |
| Zinc | 1 mg/l |
| Iron | 0.2 mg/l |
| Copper | 0.3 mg/l |

The cathodes were masked in this case to expose only circular islands on which discrete cobalt deposits were formed. The bite achieved was 46 g/l of cobalt with a catholyte pH of 2.3 and a current efficiency of 91%. After 167 hours of electrowinning the deposit was found to contain:

| | |
|---|---|
| Nickel | 252 ppm |
| Lead | <4 ppm |
| Zinc | 10 ppm |
| Iron | <8 ppm |
| Copper | <7 ppm |

By testing the effect of variations in the electrowinning parameters, the following were established as desired and preferred conditions:

| | |
|---|---|
| Feed composition: | 85–105 g/l Co preferably about 100 g/l Co; |
| Cobalt Bite: | 35–60 g/l, preferably about 45 g/l; |
| Spent electrolyte Composition: | ≧40 g/l Co, preferably >50 g/l Co; |
| Current Density: | 100–300 A/m$^2$, preferably about 200 A/m$^2$; |
| Temperature: | 50–60° C., preferably about 55° C.; |
| Catholyte pH: | 2–3, preferably about 2.5. |

The cobalt bite has to be at least 35 g/l in order to avoid slime formation problems. This need for a minimum bite is illustrated by the results of the following comparative test. Identical electrowinning experiments were carried out under conditions similar to those of the second of the aforementioned electrowinning tests except that the bite was arranged to be 45 g/l in one case and only 12 g/l in the other case. The feed electrolytes were chosen to ensure that in both cases the same cobalt level (50 g/l) was present in the spent electrolyte. After 167 hours of electrodeposition the total amount of slimes collected from the anode box and spent electrolyte was found to be 13.0 grams when the low bite was used, but only 2.0 grams when the high bite was used.

The bite cannot, however, be chosen to be above about 60 g/l without detriment to the operation. This is because at excessively high bites the catholyte pH drops to <2 and this causes both a lowering of current efficiency and pitting of the deposits. Thus a comparative test wherein a 75 g/l cobalt bite was achieved showed a current efficiency of only 55%. Moreover, a large number of pits were discovered in the deposits after 100 hours despite the presence of the sodium lauryl sulfate.

The present invention has been described with reference to preferred embodiments thereof. It will be appreciated that various modifications may be made to the details of such embodiments without detracting from the benefits of the present invention. Thus other reagents may be used for purifying the electrolyte, and other procedures adopted for the purification and eventual electrowinning. Furthermore, the steps which have been described as batch operations may be performed in a continuous or semi-continuous manner. These and other modifications are within the scope of the invention which is defined by the appended claims.

What we claim is:

1. A process in which a feed which consists of a cobaltic oxide hydrate precipitate is dissolved in a spent sulfate electrolyte from a cobalt electrowinning operation and in which at least one of the feed and spent electrolyte is contaminated with chloride ions, wherein the improvement comprises mixing the feed with the spent electrolyte to form a slurry, sparging air through the slurry for a period sufficient to liberate as gaseous chlorine substantially all of the chloride ions in the slurry, and thereafter treating the dechlorinated slurry with a reducing agent selected from the group consisting of sulfur dioxide, hydrogen peroxide and organic reagents capable of reducing cobalt to its divalent state; whereby substantially all of the cobalt in the feed is dissolved to provide a substantially chloride-free cobalt-containing solution from which pure cobalt can be electrowon.

2. A process as claimed in claim 1 wherein the spent electrolyte is initially contaminated with chlorate ions, the improvement further comprising treating the spent electrolyte with a reducing agent, effective to reduce chlorate ions to chloride ions, prior to mixing the electrolyte with the feed.

3. A process as claimed in claim 1 including the further operations of purifying the resulting cobalt-containing solution to remove therefrom any lead, iron, zinc, copper and nickel present as impurities, subjecting the purified solution to electrowinning to recover pure cobalt and recycling spent electrolyte from the electrowinning operation to be mixed with a fresh supply of feed precipitate.

4. A process as claimed in claim 3 wherein the purifying operation includes precipitating lead from solution by adding barium carbonate and separating the lead containing precipitate from the resulting lead-free solution.

5. A process as claimed in claim 3 wherein the purifying operation includes precipitating iron from solution by adding cobalt carbonate and separating the iron containing precipitate from the resulting iron-free solution.

6. A process as claimed in claim 3 wherein the purifying operation includes removing zinc, copper and nickel by means of ion exchange treatment.

7. A process as claimed in claim 6 wherein the ion exchange treatment includes use of a resin containing di(2-ethylhexyl) phosphoric acid for zinc removal.

8. A process as claimed in claim 6 wherein the ion exchange treatment includes use of a resin having bis(2-picolyl)amine functional groups for nickel removal.

9. A process as claimed in claim 3 wherein the electrowinning is carried out in cells having lead based alloy anodes.

10. A process as claimed in claim 9 wherein the cells include diaphragm means separating each anode from each cathode adjacent thereto.

11. A process as claimed in claim 10 wherein the electrowinning is carried out with a current density and flow rate correlated to ensure that a depletion of 35–60 grams per liter is achieved in the concentration of cobalt in the electrolyte.

12. A process as claimed in claim 1 wherein the feed precipitate is prepared from an initial precipitate which consists of a mixed nickel-cobalt basic precipitate in which the nickel content is at least equal to the cobalt content, and wherein the preparation of the feed comprises separating the mixed precipitate into two fractions, dissolving a first one of the fractions in a dilute mineral acid-containing solution, and introducing chlorine into the resulting solution while adding the second fraction of the mixed precipitate thereto at a rate correlated with the chlorine introduction so as to maintain the pH at between about 2.5 and 4.5, whereby substantially all of the cobalt present is precipitated to constitute the feed precipitate.

* * * * *